United States Patent [19]

Hourmouziadis

[11] Patent Number: 4,836,745

[45] Date of Patent: Jun. 6, 1989

[54] TURBO-ENGINE WITH TRANSONICALLY TRAVERSED STAGES

[75] Inventor: Jean Hourmouziadis, Hebertshausen, Fed. Rep. of Germany

[73] Assignee: MTU Muenchen, Munich, Fed. Rep. of Germany

[21] Appl. No.: 97,672

[22] Filed: Sep. 17, 1987

[30] Foreign Application Priority Data

Sep. 20, 1986 [DE] Fed. Rep. of Germany ..... 3632094

[51] Int. Cl.[4] ..... F01D 5/10

[52] U.S. Cl. ..... 415/119; 415/173.7

[58] Field of Search ..... 415/119, 177, 172 A, 415/181, DIG. 9

[56] References Cited

U.S. PATENT DOCUMENTS

| | | | |
|---|---|---|---|
| 2,427,244 | 9/1947 | Warner | 415/172 A |
| 2,494,328 | 1/1950 | Bloomberg | 415/DIG. 1 |
| 2,897,936 | 11/1959 | Faught | 415/9 |
| 3,265,291 | 8/1966 | Davis et al. | 415/172 A |
| 4,447,190 | 5/1984 | Campbell | 415/116 |
| 4,504,188 | 3/1985 | TGraver et al. | 415/DIG. 1 |

FOREIGN PATENT DOCUMENTS

| | | | |
|---|---|---|---|
| 619722 | 3/1949 | United Kingdom | 415/DIG. 1 |

*Primary Examiner*—Robert E. Garrett
*Assistant Examiner*—John T. Kwon
*Attorney, Agent, or Firm*—Barnes & Thornburg

[57] ABSTRACT

In the case of a turbo-engine with transonically traversed stages, particularly a gas turbine with a stationary forward-guiding grid, a pressure compensating arrangement for the compensation of a pressure gradients caused by the compression waves is arranged over the circumference behind the forward-guiding grid at the hub and/or at the housing. The pressure compensating arrangement comprises especially a steadying chamber in proximity of the hub of the forward-guiding grid that interacts with a radially aligned sealing flange of the rotor disk.

6 Claims, 3 Drawing Sheets

TURBO-ENGINE WITH TRANSONICALLY TRAVERSED STAGES

BACKGROUND AND SUMMARY OF THE INVENTION

The invention relates to a turbo-engine with transonically traversed stages, particularly a gas turbine with a stationary forward-guiding grid.

In the case of transonically traversed gas turbines [flow-in speed at the guide wheel in the subsonic range; median flow-out speed at the guide wheel trailing edge in the transonic range ($M>0.8$)], one or several compression waves occur in the case of a flow-off at high Mach numbers at the trailing edge of the guide wheel. These compression waves with the blade pitch generate periodic pressure gradients that are many times larger than in the subsonic range ($M<0.8$).

If hollow spaces are located outside the flow duct of the gas turbine, a flowing-in of the gas into the hollow spaces takes place at points of high pressure, and a flowing-out takes place at points of low pressure. In every section between respective blades, a circulating flow occurs at the radially outside and inside edge of the flow duct. This intensely interferes wtih the main flow, increases losses and impairs the efficiency of the gas turbine. Another disadvantage is that, when hot gas flows into the hollow spaces, the temperature of the components is increased, whereby the stability and the durability is reduced.

It is an objective of the invention to eliminate the above-mentioned disadvantages that occur in the case of a turbo-engine of the above-mentioned type and particularly to prevent or minimize a circulating flow between the blades in each between blade section at the trailing edge of the forward-guiding grid.

According to the invention, this objective is achieved by the fact that a compensating arrangement is provided over the circumference behind the guiding grid at the hub and/or housing, for the pressure compensation of pressure gradients occurring as a result of compression waves at the outlet edge of the forward-guiding grid.

This arrangement of the invention has the significant advantage that the circulating flows that occur as a result of the compression waves are prevented, and in this way, flow losses are reduced and the thermal stress to components caused by hot gas penetrating into the hollow spaces is reduced.

The compensating arrangement is preferably designed as at least one steadying or balancing chamber extending over the circumference on the side of the hub which has a circumferential opening in the direction of the rotor disk that follows, which is covered by a radially operating sealing flange of the rotor disk.

The sealing flange is advantageously developed as a double circumferential seal, each of the two circumferential seals being developed as a labyrinth seal. These measures prevent that hot gas penetrates through the gap between the rotating and the stationary parts into the hollow spaces that are located radially on the inside, and that the resulting circulating flow interferes with the main flow.

Advantageous measures may also be provided at stationary parts for the purpose of preventing or minimizing the circulating flow according to certain preferred embodiments of the invention. In particular, annuluses arranged in the housing are developed with a connection to the main flow by means of a blocking element as the throttling point.

The annulus is filled with a filler, such as metallic or mineral wool, fibers, tissue, foam. Although such loose closing or blocking of the annulus permits a pressure and temperature compensation, it prevents a significant gas flow.

Other objects, advantages and novel features of the present invention will become apparent from the following detailed description of the invention when considered in conjunction with the accompanying drawings.

DETAILED DESCRIPTION OF THE DRAWINGS

FIGS. 1 to 4 schematically depict the effect of the circulating flow C within a section t between the blades 19, 20 in the area of the trailing edge 18 of the blades, according to the state of the art construction.

Figure 1:
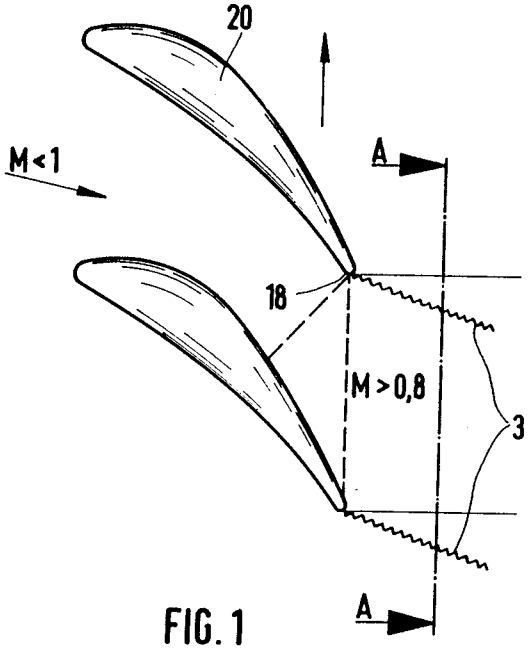
FIG. 1 is a sectional view of two adjacent guide blades of a guiding grid of a turbo-engine with a diagrammatic representation of compression waves at the trailing edge.

In the case of transonically traversed gas turbines 1 (blade entering speed in the subsonic range; blade flow-off speed in the transonic range), one or several compression waves 3 according to FIG. 1 occur during flow-off at the trailing edge 18, particularly at high Mach-numbers M. These compression waves 3 generate periodic pressure gradients 4 across the section t that are many times larger than in the subsonic range.

Figure 4:
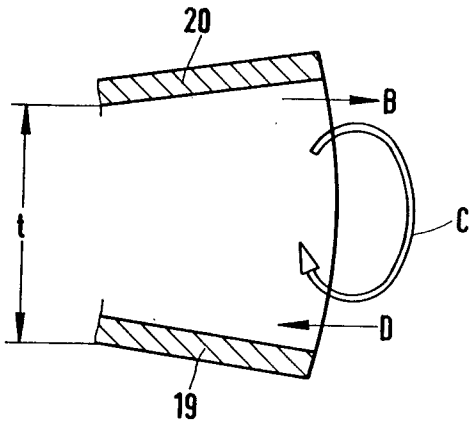
FIG. 4 schematically depicts circulating flow C according to FIG. 3 within a blade section.
Figure 2:
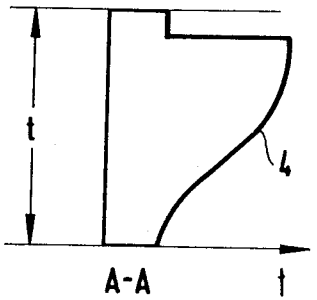
FIG. 2 is a diagrammatic representation of the pressure gradient generated by the compression waves along A—A of FIG. 1.
Figure 3:
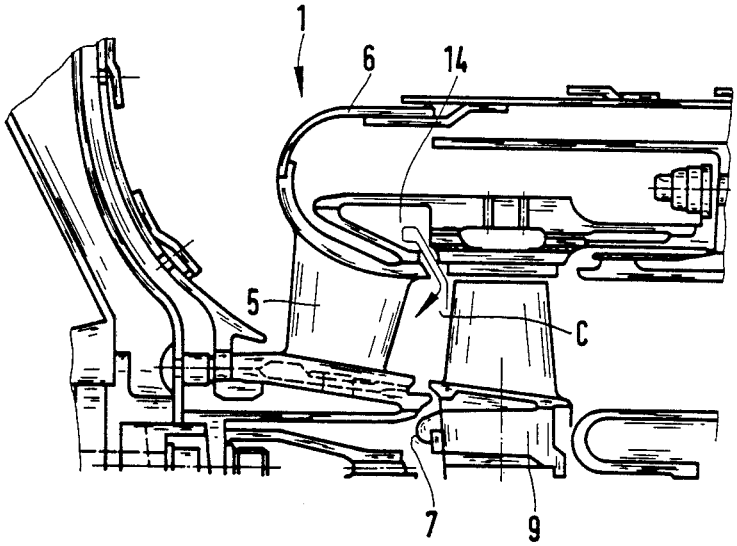
FIG. 3 is a partial axial sectional view of a gas turbine with a circulating flow C between the forward-guiding grid and the rotor disk constructed according to the state of the art.

If, for example, according to FIG. 3, outside the actual flow duct, annuluses 14 are located in the area of the housing wall, at points of high pressure an inflow B into these annuluses 14 will take place and at points of low pressure, an outflow D will take place, as shown particularly in FIG. 4. Thus, in every section, a circulating flow C occurs at the radially outside and inside edge of the flow duct. This has the result that the circulating gas at the edge of the duct interferes with the main flow, increases losses and impairs the efficiency of the gas turbine 1. In addition, the flowing-in of hot gas into the annulus 14 increases the temperature of the components reducing stability and thus durability.

Figure 5:
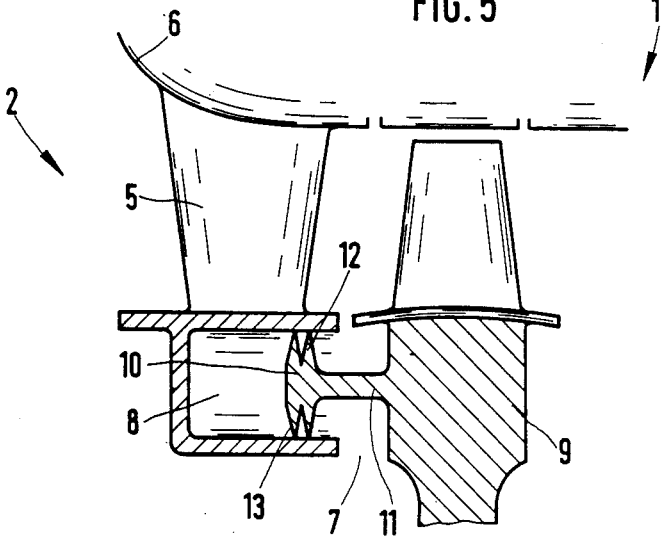
FIG. 5 is a side schematic part-sectional view depicting a steadying chamber on the side of the hub, between stationary and rotating parts, constructed in accordance with a first preferred embodiment of the invention.
Figure 6:
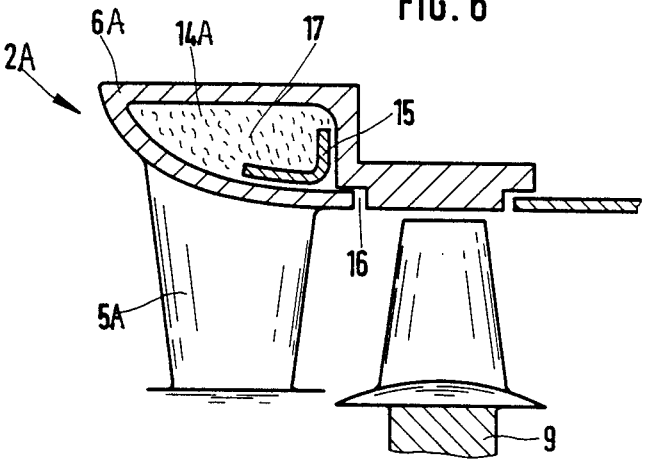
FIG. 6 is a partial axial sectional view similar to FIG. 5 depicting another preferred embodiment of the invention with a radially outside annulus at stationary parts in the area of the housing of a turbine.

By means of the invention, a pressure-compensating arrangement is suggested for the compensation of the pressure gradients 4 caused by the compression waves 3 over the circumference behind the rotor disk 9 at the hub and/or housing 6, as shown particularly in FIGS. 5 and 6.

The pressure compensating arrangement 2 according to FIG. 5 consists particularly of a balancing chamber 8 that extends in circumferential direction of the forward-guiding grid 5 at a radially inside point with a circumferential opening toward the rear to the rotor disk 9 that follows, in which case the circumferential opening is covered by means of a radially aligned sealing flange 10 of the rotor disk 9. The sealing flange 10 is fixed at the rotor disk 9 via an axial flange 11 and provides a labyrinth seal 13 at a radially inside point, and a labyrinth seal 12 at a radially outside point of the circumferential opening.

The circulating flow C according to the state of the art discussed above takes place via the upper labyrinth seal 12. In the steadying or balancing chamber 8, a certain pressure compensation will then take place in the circumferential direction, making it possible again to prevent, by means of an only slightly increased counterpressure in the interior 7, the flowing-in of hot gas via the lower labyrinth seal 13. The above-mentioned pressure compensating arrangement is located between the stationary and the rotating part of the turbine.

The embodiment of FIG. 6 places the compensating chamber in the stationary annulus 14A surrounding the stationary guide vanes (compare annulus 14 depicted in FIG. 3). In order to prevent a circulating flow C in the stationary annulus 14A of the housing 6 of the gas turbine 1, which annulus 14A is disposed between stationary parts and may be required for other reasons, it is sealed off against the main flow by means of blocking elements 15, for example, in the form of angle sections, which form a throttling point with the annulus opening 16. In order to increase the resistance to the compensation of the circulating flow C, the annulus 14A is filled with a filler 17, such as metallic or mineral wool, fibers, tissue, foam. The filler 17 and the blocking element 15 permit a pressure compensation as well as a temperature compensation in the annulus 14A.

All new characteristics that were mentioned in the specification and/or shown in the drawing are important for the invention either separately or appropriately combined, even if they are not specifically claimed in the claims.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A turbo-engine arrangement for a turbo-engine with transonically traversed stages, comprising:

a forward guiding grid having a plurality of circumferentially spaced guide blades; wherein the guide blades are stationary and extend across an annular space bounded on the outside by a housing and on the inside by a hub;

pressure compensation means for circumferentially balancing pressure gradients caused by compression waves at the downstream side of the guiding grid; and a rotatable rotor disc disposed downstream of the guide grid and having rotor blades extending substantially across a downstream extension of the annular space bounded on the outside by the housing and on the inside by the hub, said annular space accommodating the main flow through the guide grid and rotor disk, wherein the compensating means comprises an annulus arranged in the housing and having an opening connection in the direction toward the main flow, said connection including an annular blocking element in the annulus as a throttling member.

2. A turbo-arrangement according to claim 1, wherein said annulus is disposed radially outside of the guide blades.

3. A turbo-arrangement according to claim 1, wherein the annulus is filled with a filler, such as a metallic or mineral wool, fiber, tissue or foam.

4. A turbo-engine arrangement for a turbo-engine with transonically traversed stages, comprising:

a forwarding guiding grid having a plurality of circumferentially spaced guide blades; wherein the guide blades are stationary and extend across an annular space bounded on the outside by a housing and on the inside by a hub;

pressure compensation means for circumferentially balancing pressure gradients caused by compression waves at the downstream side of the guiding grid; and a rotatable rotor disc disposed downstream of the guide grid and having rotor blades extending substantially across a downstream of the annular space bounded on the outside by the housing and on the inside by the hub, said annular space accommodating the main flow through the guide grid and rotor disk, wherein the compensating means comprises an annular steadying chamber arranged radially outside the guide grid and having an annular opening in the downstream end of the guide grid which opens in the direction of the main flow in said annular space, and further comprising an annular blocking element disposed in said annular steadying chamber, said blocking element serving to throttle flow into the annular steadying chamber from the main flow annular space.

5. A turbo-engine arrangement according to claim 4, wherein said annular blocking element is formed of angle sections.

6. A turbo-engine arrangement according to claim 5, wherein the annular steadying chamber is filled with a filler such as a metallic or mineral wool, fiber, tissue or foam.

* * * * *